US010513746B2

(12) United States Patent
Myers et al.

(10) Patent No.: US 10,513,746 B2
(45) Date of Patent: Dec. 24, 2019

(54) CONTINUOUS CENTRIFUGE SYSTEMS WITH MULTIPLE-STAGE MIXING

(71) Applicant: Western States Machine Company, Fairfield, OH (US)

(72) Inventors: Steven Myers, Independence, KY (US); Graham Vidler, Coolangatta (AU); William Temple, Brookville, IN (US)

(73) Assignee: WESTERN STATES MACHINE COMPANY, Fairfield, OH (US)

( * ) Notice: Subject to any disclaimer, the term of this patent is extended or adjusted under 35 U.S.C. 154(b) by 433 days.

(21) Appl. No.: 15/296,667

(22) Filed: Oct. 18, 2016

(65) Prior Publication Data

US 2018/0105889 A1 Apr. 19, 2018

(51) Int. Cl.

| | |
|---|---|
| ***C13K 1/00*** | (2006.01) |
| ***B04B 3/00*** | (2006.01) |
| ***B04B 11/02*** | (2006.01) |
| ***B04B 11/06*** | (2006.01) |

(52) U.S. Cl.

CPC ..... *C13K 1/00* (2013.01); *B04B 3/00* (2013.01); *B04B 11/02* (2013.01); *B04B 11/06* (2013.01)

(58) Field of Classification Search

CPC ..... C13K 1/00; B04B 3/00; B04B 11/02

See application file for complete search history.

(56) References Cited

U.S. PATENT DOCUMENTS

| | | | |
|---|---|---|---|
| 3,428,182 | A | 2/1969 | Hillebrand |
| 3,989,185 | A | 11/1976 | Mercier |
| 7,208,048 | B2 | 4/2007 | Eastaughffe |
| 8,721,793 | B2 | 5/2014 | Hoffmann |
| 9,174,224 | B2 | 11/2015 | Bartsch et al. |
| 9,180,467 | B2 | 11/2015 | Bartsch et al. |
| 2015/0290662 | A1 | 10/2015 | Lehnberger et al. |

OTHER PUBLICATIONS

Philippines Examiners Report dated Mar. 7, 2018 pertaining to Philippines Patent App. No. 1-2017-000294, 8 Pages.

Office Action pertaining to corresponding Philippine Patent Application No. 1/2017/000294, dated Oct. 10, 2019.

*Primary Examiner* — David A Reifsnyder

(74) *Attorney, Agent, or Firm* — Dinsmore & Shohl LLP

(57) ABSTRACT

The present disclosure includes a centrifuge system for processing a massecuite composition. The centrifuge system may include a centrifuge having a vertical spindle, a housing, and a basket disposed within the housing. The basket may include a central hub coupled to the vertical spindle for rotation therewith, a cup coupled to the central hub or an end of the vertical spindle, and a loading cone positioned over the cup and coupled to the cup by a plurality of vanes extending outward from the cup to the loading cone. The loading cone may have a wide end open towards a bottom of the basket, and the plurality of vanes may be radially spaced apart. The centrifuge system may further include a feed pipe vertically disposed above the cup and having a feed outlet oriented towards the cup. The cup defining a cavity oriented in a direction away from the central hub.

25 Claims, 8 Drawing Sheets

CONTINUOUS CENTRIFUGE SYSTEMS WITH MULTIPLE-STAGE MIXING

TECHNICAL FIELD

Embodiments of the present disclosure generally relate to continuous centrifuge systems, in particular continuous centrifuge systems having multiple-stage mixing.

BACKGROUND

The processing of sugar to produce refined sugar can include several steps, for example, an evaporation step followed by a crystallization process. During an evaporation step, sugar liquor may be concentrated to sugar syrup. Sugar crystals may also evaporate out of solution. The sugar syrup may then be sent to crystallizers for further processing to produce sugar crystals. The resulting mixture from the crystallization step is called massecuite, which may be composed of sugar crystals in a thick, viscous liquid (molasses). The massecuite may also contain dissolved sugar and organic and inorganic impurities. To isolate the sugar crystals, the massecuite may be processed through a centrifuge to separate the sugar crystals from the liquid molasses.

During centrifuge processing, the efficiency and speed of separating the liquid molasses from the solid sugar crystals can be dependent, in part, upon the viscosity of the continuous liquid phase massecuite. Highly viscous massecuite can impede the release of the liquid molasses from the crystals during centrifugation. Viscosity reduction may not necessarily be easily accomplished because the crystals are in equilibrium with the liquid phase and any change by, for example, dilution or temperature may cause the crystals to dissolve.

There are devices available to increase the flowability of the massecuite in large mixers and heat exchangers, but because these devices are so far upstream of the centrifuge processing step, these devices may not provide as thorough viscosity reduction as desired because of the risk of dissolving crystals as mentioned above. Several pre-conditioning systems have been developed over the years including, for example, the Steven Coil by Western States, but these devices are generally reserved for heating the massecuite and agitating the massecuite to facilitate an even distribution of heat transfer. These heated mixers can be very large, and are piped between the crystallizers and centrifuges, and can have very long-residence times.

SUMMARY

Accordingly, an ongoing need exists for improved centrifuge systems, and components thereof, which deliver homogeneous massecuite compositions to a centrifuge.

According to one or more embodiments, a centrifuge system is disclosed that may comprise a centrifuge having a vertical spindle, a housing, and a basket disposed within the housing. The basket may further comprise a central hub coupled to the vertical spindle for rotation therewith; a cup coupled to the central hub or an end of the vertical spindle, the cup defining a cavity oriented in a direction away from the central hub; and a loading cone positioned over the cup and coupled to the cup by a plurality of vanes extending outward from the cup to an inner surface of the loading cone. The loading cone may have a wide end open towards a bottom of the basket, and the plurality of vanes may be radially spaced apart. The centrifuge system may further include a feed pipe vertically disposed above the cup and having a feed outlet oriented towards the cup.

According to one or more other embodiments, a method for providing a homogeneous massecuite to a centrifuge is disclosed that comprises providing a centrifuge system, which may comprise a centrifuge having a vertical spindle, a housing, and a basket disposed within the housing. The basket may further comprise a central hub coupled to the vertical spindle for rotation therewith; a cup coupled to the central hub or an end of the vertical spindle, the cup defining a cavity oriented in a direction away from the central hub; and a loading cone positioned over the cup and coupled to the cup by a plurality of vanes extending outward from the cup to an inner surface of the loading cone. The loading cone may have a wide end open towards a bottom of the basket, and the plurality of vanes may be radially spaced apart. The centrifuge system may also include a feed pipe vertically oriented above the cup and having a feed outlet oriented towards the cup. The method further comprises introducing a massecuite composition from the feed outlet to a first mixing zone and mixing the massecuite composition in the first mixing zone through conveying the massecuite composition by centrifugal force outward along an upper surface of a base of the cup, inpinging of the massecuite composition against a first inner radial surface of a cylindrical sidewall of the cup, and conveying of the massecuite composition axially along the first inner radial surface of the cylindrical sidewall of the cup to a lip of the cup. The method may further comprise introducing the massecuite composition to a second mixing zone extending from the lip of the cup to the wide end of the loading cone and mixing the massecuite composition in the second mixing zone through slinging the massecuite composition radially across a gap defined between the lip of the cup and an inner surface of the loading cone, impinging the massecuite composition against the inner surface of the loading cone, and conveying the massecuite composition through centrifugal force downward along the inner surface of the loading cone to the wide end of the loading cone.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
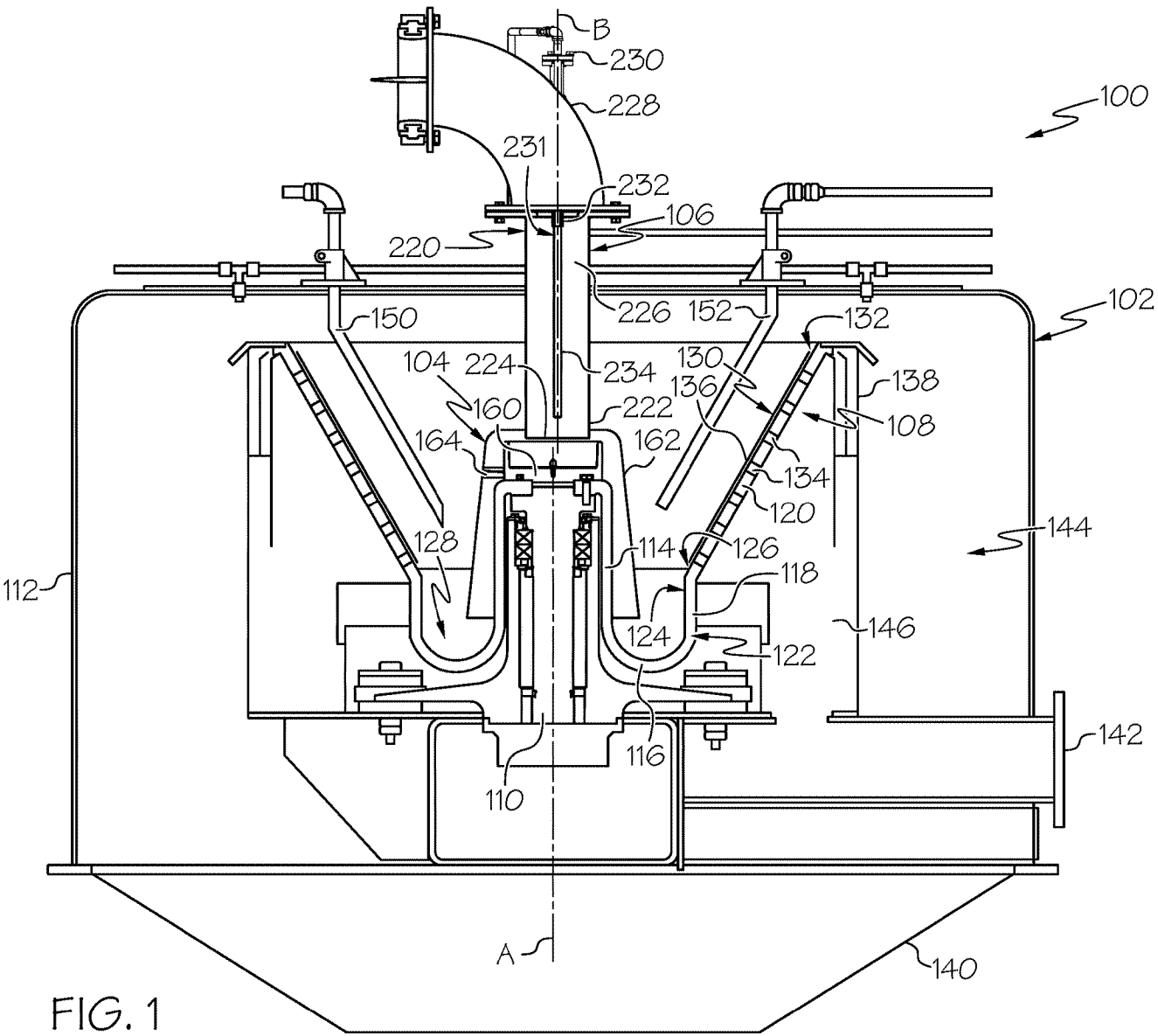
FIG. 1 schematically depicts a centrifuge system, in accordance with one or more embodiments of the present disclosure.

Embodiments of the present disclosure are directed to continuous centrifuge systems having multiple-stage mixing for providing a homogeneous massecuite composition to a centrifuge. Specifically, continuous centrifuge systems are disclosed that include a feed pipe and a centrifuge having a mixing apparatus coupled thereto for continuously providing a homogeneous massecuite composition to the basket of the continuous centrifuge system. Referring to FIG. 1, the continuous centrifuge systems, generally referred to herein by the reference number 100, may include a centrifuge 102 having a vertical spindle 110, a housing 112, and a basket 108 disposed within the housing 112. The centrifuge system 100 may also include a feed pipe 106. The basket 108 of the centrifuge 102 may further include a central hub 114 coupled to the vertical spindle 110 for rotation therewith. The centrifuge 102 may further include a mixing apparatus 104. The mixing apparatus 104 may include a cup 160 coupled to the central hub 114 or an end of the vertical spindle 110 for rotation therewith and a loading cone 162 positioned over the cup 160 and coupled to the cup 160 by a plurality of vanes 164 extending outward from the cup 160 to an inner surface 166 of the loading cone 162.

As used herein, the term "vertical" refers generally to a direction parallel with an axis of rotation A of the vertical spindle 110 of the centrifuge system 100. Generally, the vertical direction will be parallel to a gravitational force vector at the surface of the Earth (i.e., vertical is perpendicular to the ground).

Figure 2:
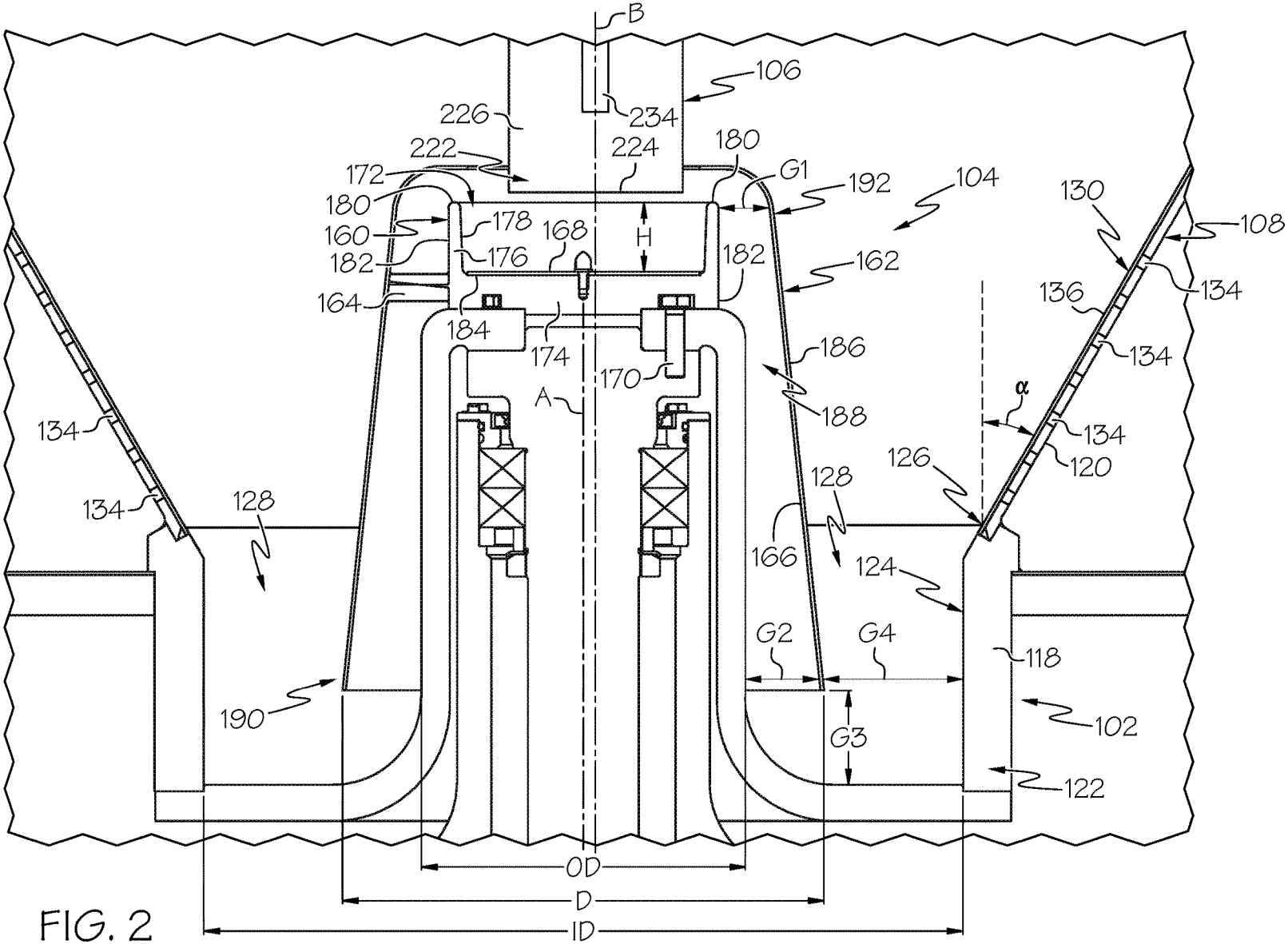
FIG. 2 schematically depicts a mixing apparatus of the centrifuge system of FIG. 1, in accordance with one or more embodiments of the present disclosure.

Referring now to FIGS. 1 and 2, a continuous centrifuge system 100 according to one or more embodiments of the present disclosure is depicted. The continuous centrifuge system 100 may include a centrifuge 102, a mixing apparatus 104 coupled to the centrifuge 102, and a feed pipe 106 which may be positioned to deliver a composition to the mixing apparatus 104 of the centrifuge 102. The continuous centrifuge system 100 may operate to separate the liquid and solid phases of a suspension. Particularly in a sugar centrifuge system, the continuous centrifuge system 100 may operate to separate a massecuite composition into sugar crystals and liquid molasses. A massecuite composition may include sugar crystals, molasses, and one or more added components, such as water, diluted lower-viscosity molasses, surfactant, other additives, or combinations thereof, for example. One or more additives may be added to the massecuite composition in the feed pipe 106, which is further described below, such that the massecuite composition fed to the continuous centrifuge system 100 may be a non-homogeneous stream of materials having different viscosities. The massecuite along with the additives, such as water or lower-viscosity molasses, having different viscosities may be mixed by the mixing apparatus 104 to produce a generally homogeneous massecuite composition. During sugar processing, for example, the mixing apparatus 104 may provide homogeneous mixing of a highly viscous massecuite with one or more lower-viscosity fluids to produce a homogeneous massecuite composition that may then be fed to the centrifuge 102. As used herein, "homogeneous" does not require a fully homogeneous operation.

The centrifuge 102 may include a basket 108 coupled to a vertical spindle 110 and disposed within a housing 112. The basket 108 may be coupled to the vertical spindle 110 by a central hub 114 for rotation of the basket 108 with the vertical spindle 110. Central hub 114 may also be referred to herein as hub 114. The basket 108 may further include a bottom wall 116, a solid radial wall 118, and a separating wall 120. The solid radial wall 118 may be spaced apart from the hub 114 of the basket 108 and the bottom wall 116 may extend from the hub 114 to a bottom portion 122 of the solid radial wall 118. The solid radial wall 118 may have an inner radial surface 124, which may have a generally circular cross-section. The solid radial wall 118 may extend upward from the bottom wall 116 to a lower edge 126 of the separating wall 120 of the basket 108. In one or more embodiments, the solid radial wall 118 may extend generally upward from the bottom wall 116 to the lower edge 126 of the separating wall 120 of the basket 108. In one or more embodiments, the solid radial wall 118 may increase in cross-sectional diameter moving upward from the bottom wall 116 to the lower edge 126 of the separating wall 120. In one or more embodiments, the solid radial wall 118 may be a conical radial wall. In one or more embodiments, the solid radial wall 118 and/or the bottom wall 116 may be part of an annular bracket (not shown) that may be coupled to the basket 108, and the annular bracket (not shown) may have a lip portion (not shown) to aid in securing the filtering screen 136 to the separating wall 120 of the basket 108.

The basket 108 may define an annular channel 128 radially positioned between the hub 114 or the vertical spindle 110 and the solid radial wall 118 of the basket 108. The annular channel 128 may be centered about the vertical spindle 110 and may be defined by the hub 114, the inner radial surface 124 of the solid radial wall 118, and the bottom wall 116 of the basket 108, which extends between the hub 114 and the solid radial wall 118 of the basket 108.

The separating wall 120 of the basket 108 may have an inner circular surface 130 and may extend in an upward direction towards an upper edge 132 of the basket 108. The separating wall 120 of the basket 108 may have a plurality of perforations 134 that permit liquids to pass through the separating wall 120. In one or more embodiments, the lower edge 126 of the separating wall 120 may have a radial dimension (i.e., radius, diameter, cross-sectional area, etc.) that is less than a radial dimension of the upper edge 132 of the separating wall 120. In general, the separating wall 120 may have various shapes, including but not limited to, cylindrical, conical, frustoconical, bell-shaped, or other shapes, for example. In one or more embodiments, the separating wall 120 may be a perforated frustoconical basket having a cone angle α of from 20 degrees to 40 degrees, or from 25 degrees to 35 degrees. In other embodiments, the separating wall 120 may be a perforated cylindrical wall extending vertically from the lower edge 126 to the upper edge 132.

The basket 108 may include a filtering screen 136, which may have a fine mesh for separating the solids from the liquid of a solid suspension, such as separating the solid sugar crystals from the liquid molasses of a massecuite composition. The basket 108 may include an intermediate filter screen (not shown) disposed between the filtering screen 136 and the separating wall 120 of the basket 108. The intermediate filter screen may provide support for the filtering screen 136 and may allow the molasses to flow through it to one or more of the perforations 134 in the separating wall 120.

The vertical spindle 110 may be supported in the housing 112 and coupled to a motor (not shown) for rotation of the vertical spindle 110 about an axis of rotation A. Other configurations may be used to support the vertical spindle 110. For example, the vertical spindle 110 may be supported on a frame structure (not shown) within the centrifuge 102. The vertical spindle 110 and the basket 108 coupled thereto may be driven at various rotational speeds, and the separating wall 120 of the basket 108 may be operable to separate a solid suspension (e.g., a homogenous massecuite composition) into a solid component (e.g., the solid sugar crystals of the massecuite composition) and a liquid component (e.g., liquid molasses component of the massecuite composition). Selection of the rotational speed of the centrifuge 102 may be influenced by the characteristics of the solid suspension, in particular a massecuite composition (e.g., size of the sugar crystals, amount of sugar crystals, viscosity, etc.); shape and size of the basket 108; throughput of the centrifuge 102; other factors or characteristics of the continuous centrifuge system 100; or combinations thereof. The centrifuge 102, including the vertical spindle 110 and the basket 108, may be driven at a rotational speed of from 800 rotations per minute (rpm) to 2500 rpm, from 800 rpm to 2200 rpm, from 800 rpm to 1800 rpm, from 1000 rpm to 2500 rpm, from 1000 rpm to 2200 rpm, or from 1000 rpm to 1800 rpm to separate a homogeneous massecuite composition into its sugar crystal and liquid molasses components. In one or more embodiments, the centrifuge 102 may be driven at a rotational speed from 800 rpm to 2200 rpm. In one or more other embodiments, the centrifuge 102 may be driven at a rotational speed of from 1000 rpm to 1800 rpm.

In addition to providing support for the vertical spindle 110, the housing 112 may comprise a labyrinth 138, one or more solid outlets 140, and one or more liquid outlets 142. The labyrinth 138 may surround the basket 108 disposed within the housing 112. The labyrinth 138 may function to separate a solids discharge passageway 144, which extends from the upper edge 132 of the separating wall 120 of the basket 108 to the solid outlets 140, from a liquid discharge passageway 146, which extends from the perforations 134 through the separating wall 120 to the liquid outlets 142. Thus, the labyrinth 138 may generally prevent the molasses from entering the solid discharge passageway 144 and recombining with the solid sugar crystals.

The solid discharge passageway 144 may be a passage defined between the labyrinth 138 and the housing 112 of centrifuge 102. The solid discharge passageway 144 may define a solid flow path from the upper edge 132 of the separating wall 120 of the basket 108 and the solid outlets 140 of the housing 112. The separated solids (e.g., sugar crystals) may exit the basket 108 at the upper edge 132 of the separating wall 120, may fall through the solid discharge passageway 144, and may exit from the housing 112 from the one or more solid outlets 140. In one or more embodiments, the housing 112 of the centrifuge 102 may include a plurality of solid outlets 140. In one or more embodiments, the solid outlets 140 are disposed at a lower end of the solid discharge passageway 144. The housing 112 may define one or more liquid outlets 142 disposed at a lower end of the housing 112. The liquid discharge passageway 146 may be defined between the labyrinth 138 and the basket 108. The liquid discharge passageway 146 may define a liquid flow path from the perforations 134 in the separating wall 120 to the one or more liquid outlets 142. The perforations 134 in the separating wall 120 may be in fluid communication with the liquid outlets 142 by way of the liquid discharge passageway 146. During operation of the continuous centrifuge system 100 to separate a massecuite composition, the molasses separated from the sugar crystals may be discharged through the liquid outlets 142, and the sugar crystals may be discharged through the solid outlets 140. In one or more embodiments, the centrifuge 102 may include a plurality of liquid outlets 142.

The centrifuge 102 may include a wash pipe 150, which may be used to introduce a volume of wash liquid into the basket 108 area, and a centrifuge steam pipe 152, which may be used to introduce steam into the basket 108 area. The wash pipe 150 and/or the centrifuge steam pipe 152 may be used at or near the operating rotational speed of the centrifuge 102 to remove contaminants and/or the molasses film that may remain on the sugar crystals. The wash pipe 150 may spray wash liquid onto the sugar crystals on an upper portion of the filtering screen 136 proximal to the upper edge 132 of the separating wall 120 or onto the massecuite composition or partially separated massecuite composition on a lower portion of the filtering screen 136 proximal to the lower edge 126 of the separating wall 120. Wash liquid sprayed on the sugar crystal bed on the upper portion of the filtering screen 136 may pass through the sugar crystal bed, flow through the filtering screen 136 and perforations 134 of the separating wall 120, and combine with the molasses in the liquid discharge passageway 146.

The centrifuge steam pipe 152 may be directed onto the massecuite composition at or near the lower edge 126 of the separating wall 120 and filtering screen 136, which may decrease the viscosity of the massecuite composition in part through increasing the temperature of the massecuite composition and/or in part by adding low-viscosity water to the massecuite composition through condensation of the steam. Steam may also be introduced to the sugar crystals on the upper portion of the filtering screen 136 proximal to the upper edge 132 of the separating wall 120 to aid in removing the film of molasses from the sugar crystals. As with the wash liquid, at least a portion of the condensed water from the steam may pass through the filtering screen 136, through the perforations 134 in the separating wall 120, and out through the liquid outlets 142. The use of wash liquid and/or steam may be reduced or the timing varied to minimize loss of sugar crystals, which may occur through dissolution of the sugar crystals into the wash liquor or steam. The wash liquid and/or steam may be applied when the bulk of the liquid molasses has been separated so as to avoid potentially washing sugar crystals too early, which may require excess wash liquid to remove molasses that would otherwise be removed by centrifugal force, or potentially washing too late, which may require extra spin time (i.e., additional residence time on the filtering screen 136 of the centrifuge 102) to remove the wash liquor from the sugar crystals.

Figure 3:
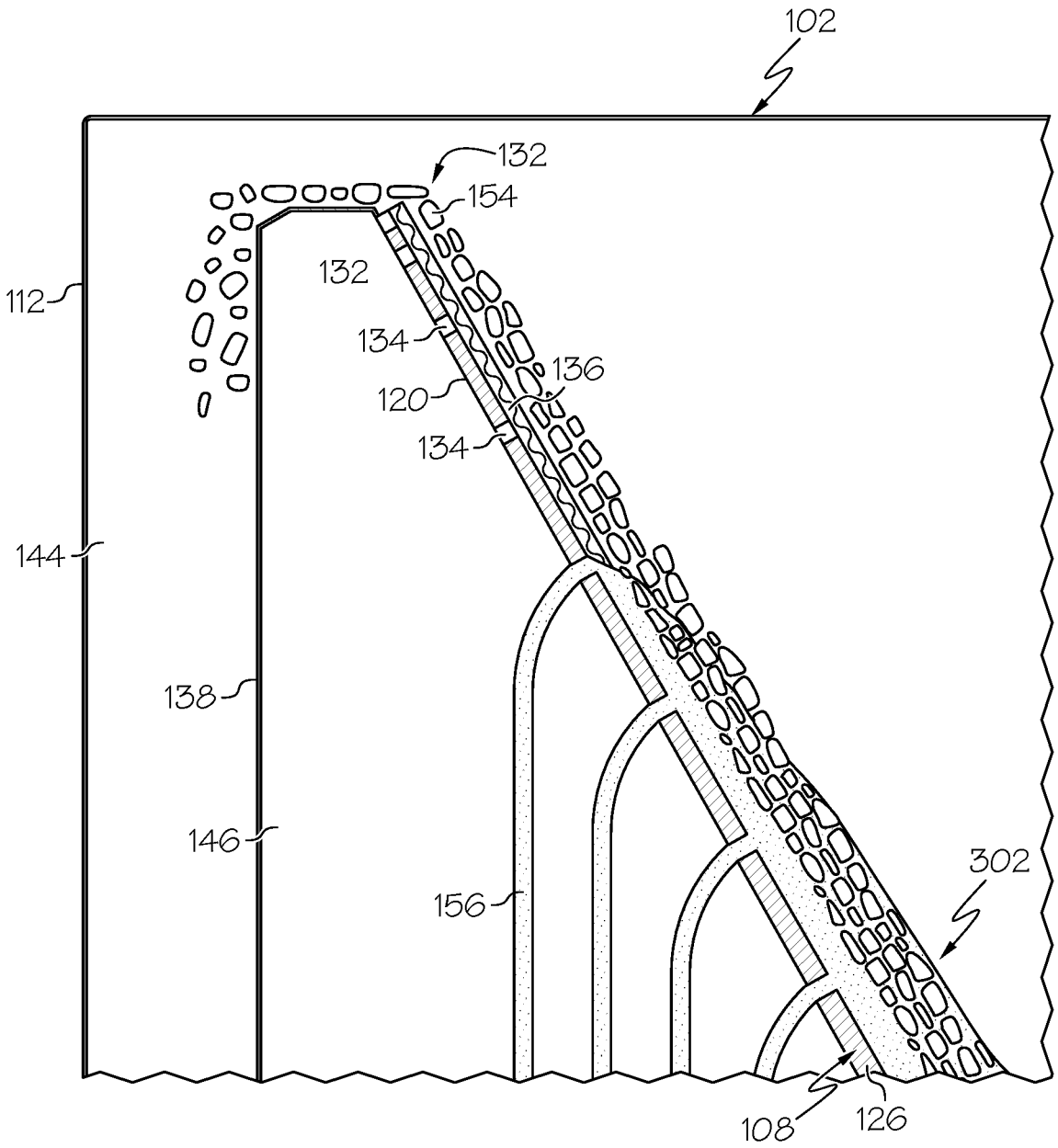
FIG. 3 schematically depicts operation of a basket and a filtering screen of the centrifuge system of FIG. 1, in accordance with one or more embodiments of the present disclosure.

In operation, as shown in FIG. 3, the separating wall 120 of basket 108 may be angled such that the sugar crystals 154 (i.e., solid) and the liquid molasses 156 (i.e., liquid) can migrate up the separating wall 120 of the basket 108 as the centrifuge 102 rotates about the axis of rotation A (FIGS. 1 and 2). The liquid molasses 156 may flow through the perforations 134 of the separating wall 120 as it is subjected to increasing centrifugal force of rotation. The sugar crystals 154 remain on the filtering screen 136 coupled to the separating wall 120 and move to the upper edge 132 of the separating wall 120, where the sugar crystals are discharged over the upper edge 132 of the separating wall 120, through solid discharge passageway 144, and out of the solid outlets 140 (FIG. 1). As depicted in FIG. 1, the labyrinth 138 may guide the liquid molasses 156 from the perforations 134 in the separating wall 120, through the liquid discharge passageway 146, and to the liquid outlets 142. The continuous centrifuge system 100 may be performed at a massecuite composition temperature from 50° C. to 80° C. and/or with a massecuite composition having a viscosity from 50,000 centipoises to 120,000 centipoises.

Referring now to FIG. 2, the mixing apparatus 104 of the centrifuge 102 may include a cup 160 and a loading cone 162 coupled to the cup 160 by a plurality of vanes 164 extending from the cup 160 to an inner surface 166 of the loading cone 162. The cup 160 may be coupled to the hub 114 of the basket 108 and/or the vertical spindle 110 by one or more fasteners 170. The cup 160 may define a central cavity 172 facing in a direction parallel to the axis of rotation A of the vertical spindle 110 and away from the vertical spindle 110. In one or more embodiments, the central cavity 172 may be defined by a recess in an upper surface 168 of the cup 160. In one or more embodiments, the central cavity 172 may be a hemispherical recess in the upper surface 168 of the cup 160.

Referring to FIG. 2, in one or more embodiments, the cup 160 may include a base 174 and a generally cylindrical sidewall 176 extending axially from the base 174 in an upward direction away from the vertical spindle 110, and the central cavity 172 may be defined by the upper surface 168 of the base 174 and an inner radial surface 178 of the cylindrical sidewall 176. The base 174 of the cup 160 may be mounted to the vertical spindle 110 by the one or more fasteners 170. The sidewall 176 of the cup 160 may be radially continuous. The inner radial surface 178 of the sidewall 176 may face generally inward toward the axis of rotation A of the vertical spindle 110 and may have a shape that is cylindrical, conical, frustoconical, hemispherical, tori-spheroidal, inverted bell-shaped, or other shapes. In one or more embodiments, the inner radial surface 178 of the sidewall 176 may be cylindrical and may have a constant radial diameter along a height of the sidewall 176, the height H being defined from the upper surface 168 of the base 174 to a top lip 180 of the cup 160. In other embodiments, the inner radial surface 178 of the sidewall 176 may be curved from the top lip 180 to the base 174. In one or more embodiments, the inner radial surface 178 of the sidewall 176 may be hemispherical. The outer surface 182 of the sidewall 176 may face generally outward towards the inner surface 166 of the loading cone 162. In one or more embodiments, the outer surface 182 of the sidewall 176 may be cylindrical and may have a constant radial diameter along the height H of the sidewall 176. The upper surface 168 of the base 174 may receive a composition or material, such as a massecuite composition for example, from a feed pipe outlet 224 of the feed pipe 106.

A cover plate 184 may be coupled to the base 174 by a central fastener. The cover plate 184 may prevent materials (e.g., the massecuite composition) from flowing into and accumulating in the fastener recesses. The cover plate 184 may provide a uniform surface for the upper surface 168 of the base 174 so that a generally radial flow of the massecuite composition across the upper surface 168 of the base 174 is not interrupted by the fasteners 170 or fastener recesses. In this manner, the massecuite composition may flow uninterrupted along the upper surface 168 of the base 174 of the cup 160.

Referring to FIG. 2, the loading cone 162 may include a radially continuous outer wall 186, and the inner surface 166 of the loading cone 162 (i.e., inner surface 166 of the radially continuous outer wall 186) may define a loading cone cavity 188. The loading cone 162 may be positioned over the cup 160 of the mixing apparatus 104 so that the cup 160 is completely contained within the loading cone cavity 188. In one or more embodiments, the inner surface 166 of the loading cone 162 may completely surround the cup 160. With the loading cone 162 positioned over and surrounding the cup 160, the inner surface 166 of the loading cone 162 is spaced apart from the outer surface 182 of the cup 160 to define a first radial gap G1 between the outer surface 182 of the cup 160 at the lip 180 of the cup 160 and the inner surface 166 of the loading cone 162. The loading cone 162 may include a wide end 190 oriented vertically downward toward a bottom wall 116 of the basket 108 of the centrifuge 102 and a narrow end 192 positioned at an axial end of the radially continuous outer wall 186 opposite from the wide end 190 and oriented vertically upward away from the bottom wall 116 of the basket 108. The narrow end 192 of the loading cone 162 may be axially positioned vertically above the top lip 180 of the cup 160, and the wide end 190 of the loading cone 162 may be axially positioned vertically below the cup 160.

The loading cone 162 may have a generally circular loading cone cross-section, which may have a loading cone diameter D that increases moving vertically downward from the narrow end 192 to the wide end 190. In one or more embodiments, the loading cone diameter D at the wide end 190 of the loading cone 162 is greater than the loading cone diameter D at the narrow end 192 of the loading cone 162. In one or more embodiments, the loading cone diameter D may increase linearly moving downward from the narrow end 192 to the wide end 190. The loading cone 162 may have a cross-sectional shape that may be, but is not limited to, conical, frustoconical, bell-shaped, or other shape. In one or more embodiments, the loading cone 162 may be a frustoconical loading cone. In one or more embodiments, the loading cone 162 may be a bell-shaped loading cone. When the loading cone 162 is rotated with the vertical spindle 110 during operation of the continuous centrifuge system 100, the centrifugal forces acting on a layer of the massecuite composition, which is flowing downward along the inner surface 166 of the loading cone 162, increases with increasing loading cone diameter D moving from the narrow end 192 to the wide end 190 of the loading cone 162. The increasing centrifugal forces, along with gravitational forces, may contribute to the migration or flow of the massecuite composition downward along the inner surface 166 of the loading cone 162 to the wide end 190 of the loading cone 162. A rate at which the loading cone diameter D changes moving from the narrow end 192 to the wide end 190 may influence the flow rate of the massecuite composition down the inner surface 166 of the loading cone 162 to the wide end 190. Increasing the loading cone diameter D moving downward towards the wide end 190 of the loading cone 162 may increase the flow rate of the massecuite composition as it moves downward towards the wide end 190 of the loading cone 162.

Figure 4:
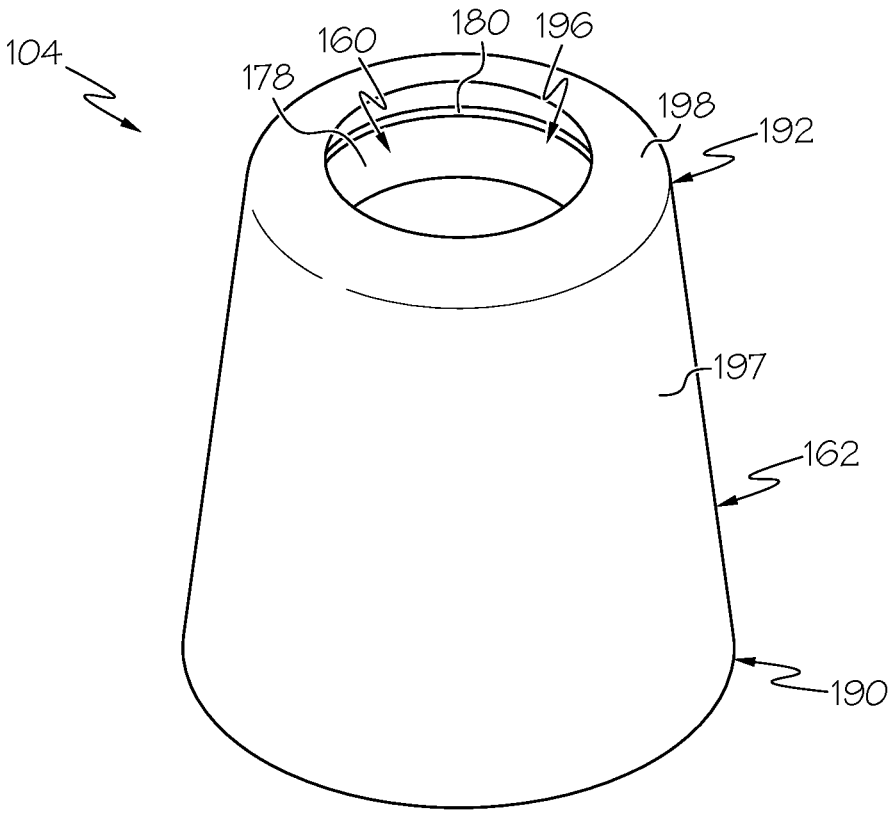
FIG. 4 is a front perspective view of the mixing apparatus of FIG. 2, in accordance with one or more embodiments of the present disclosure.

Referring to FIG. 4, the loading cone 162 may have an upper wall 194 (FIG. 4) that may extend inward from the radially continuous outer wall 186 toward the axis of rotation A of the vertical spindle 110. The upper wall 194 may have an upper axial surface. The upper wall 194 may define an opening 196 through which the feed pipe 106 of the continuous centrifuge system 100 may extend to deliver the massecuite composition to the cup 160 disposed within the loading cone 162. Referring back to FIG. 2, the loading cone diameter D at the wide end 190 of the loading cone 162 may be greater than an outer diameter OD of the hub 114 of the basket 108 and less than an inner diameter ID of the inner radial surface 124 of the solid radial wall 118. In one or more embodiments, the wide end 190 of the loading cone 162 may extend at least partially into the annular channel 128 defined between the hub 114 and the inner radial surface 124 of the solid radial wall 118.

The inner surface 166 of the loading cone 162 may be spaced apart from the hub 114 of the basket 108 to define a second radial gap G2 between the inner surface 166 of the loading cone 162 and the hub 114. The second radial gap G2 may allow the massecuite composition to flow down the inner surface 166 of the loading cone 162, between the loading cone 162 and the hub 114, to the wide end 190 of the loading cone 162. The wide end 190 of the loading cone 162 may be vertically spaced apart (i.e., axially spaced apart) from the bottom wall 116 of the basket 108 to define a third gap G3 between the wide end 190 of the loading cone 162 and the bottom wall 116 of the basket 108. The third gap G3 allows the massecuite composition reaching the wide end 190 of the loading cone 162 to flow around the wide end 190 of the loading cone 162, where the massecuite composition is then slung radially outward, through centrifugal force, towards the solid radial wall 118 of the basket 108. The wide end 190 of the loading cone 162 may be radially spaced apart from the inner radial surface 124 of the solid radial wall 118 to define a fourth gap G4 radially positioned between the loading cone 162 and the solid radial wall 118.

Referring to FIG. 4, in one or more embodiments, the loading cone 162 may be a two part loading cone comprising an outer wall 197 and a top portion 198. The loading cone 162 may be coupled to the cup 160 by attaching the inner surface 166 of the outer wall 197 of the loading cone 162 to each of the plurality of vanes 164 extending radially outward from the outer surface 182 of the cup 160. The loading cone 162 may be attached to the plurality of vanes 164 by welding, brazing, sintering, fastening with one or more fasteners, adhering, press fitting or other interference fitting methods, other fastening means, or combinations thereof. The interface between the vanes 164 and the inner surface 166 of the loading cone 162 may be smoothed out and/or sealed to prevent buildup of material at the interface and/or minimize disruption of the flow of material down the inner surface 166 of the loading cone 162. Once the outer wall 197 is coupled to the plurality of vanes 164, the top portion 198 may be coupled to the outer wall 197 of the loading cone 162 by welding, brazing, sintering, fastening with or more fasteners, adhering, press fitting or other interference fitting methods, other fastening means, or combinations thereof.

Referring now to FIGS. 4-7, each of the vanes 164 may extend radially outward from the outer surface 182 of the cup 160 to the inner surface 166 of the loading cone 162. Each of the plurality of vanes 164 may be radially spaced apart from each of the other of the plurality of vanes 164. In one or more embodiments, the plurality of vanes 164 may be radially and evenly distributed about the outer surface 182 of the cup 160 to maintain balanced rotation of the centrifuge 102 and mixing apparatus 104 during operation of the continuous centrifuge system 100. A number of vanes 164 may be selected to provide sufficient strength to the mixing apparatus 104 to withstand the rotational speeds of the centrifuge 102 while also minimizing interruption of the flow of the massecuite composition downward along the inner surface 166 of the loading cone 162. The number of vanes 164 may be at least 2, at least 3, at least 4, at least 5, at least 6, or more than 6. In one or more embodiments, the number of vanes 164 may be at least 2. In one or more embodiments, the number of vanes 164 may be from 2 to 6. In one or more embodiments, the number of vanes 164 may be 3 and the vanes 164 may be radially spaced 120 degrees (°) apart from one another. In one or more embodiments, the number of vanes 164 may be 2 and the vanes 164 may be radially spaced 180° apart from each other. In one or more embodiments, the number of vanes may be 4 and the vanes 164 may be radially spaced 90° apart from each other.

A cup end 200 of each of the vanes 164 may be coupled to the outer surface 182 of the cup 160, and a loading cone end 202 of each vane 164 may be coupled to the inner surface 166 of the loading cone 162. Methods of coupling the vanes 164 to the cup 160 and the loading cone 162 may include, but are not limited to, welding, brazing, sintering, fastening with one or more fasteners, adhering, press fitting or other interference fitting methods, other fastening means, or combinations thereof. In one or more embodiments, each of the vanes 164 may be formed integral with the cup 160 by one or more forming methods, which may include casting, molding, machining, stamping, polishing, other forming method, or combinations of these. In one or more embodiments, the vanes 164 may be welded to the outer surface 182 of the cup 160 and the inner surface 166 of the loading cone 162. The cup end 200 of each vane 164 may have a surface shaped to match the contour of the outer surface 182 of the cup 160. Likewise, the loading cone end 202 of each vane 164 may have a surface shaped to conform to the contour of the inner surface 166 of the loading cone 162.

Figure 5:
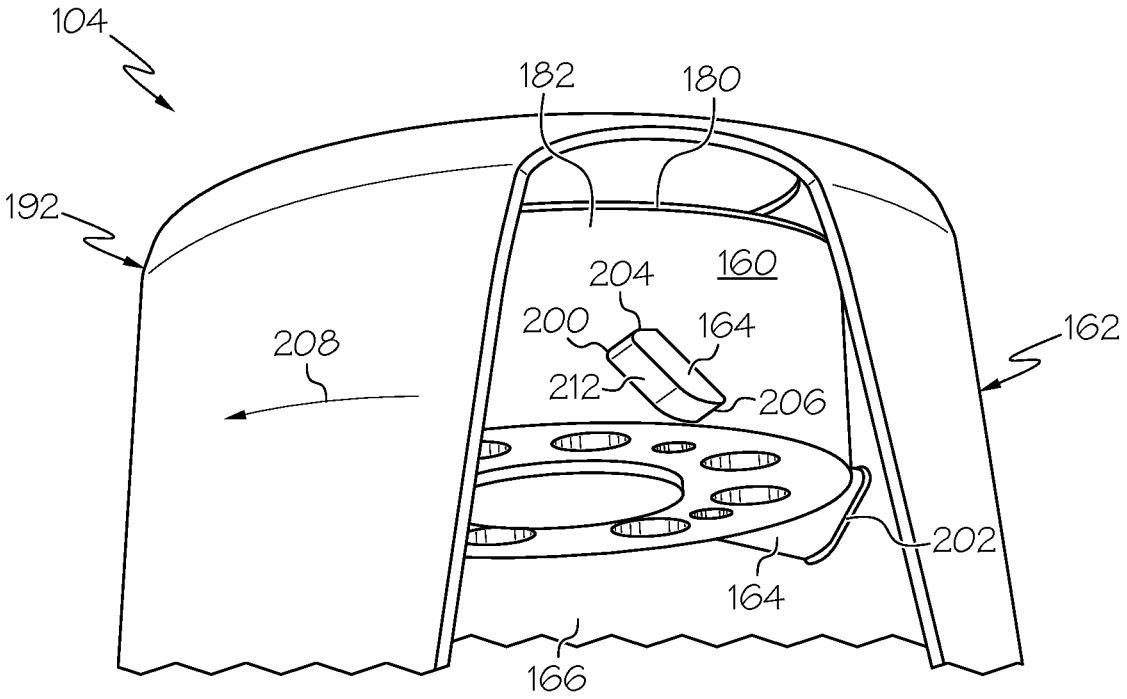
FIG. 5 is a front perspective view, in partial cross-section, of the mixing apparatus of FIG. 2, in accordance with one or more embodiments of the present disclosure.
Figure 6:
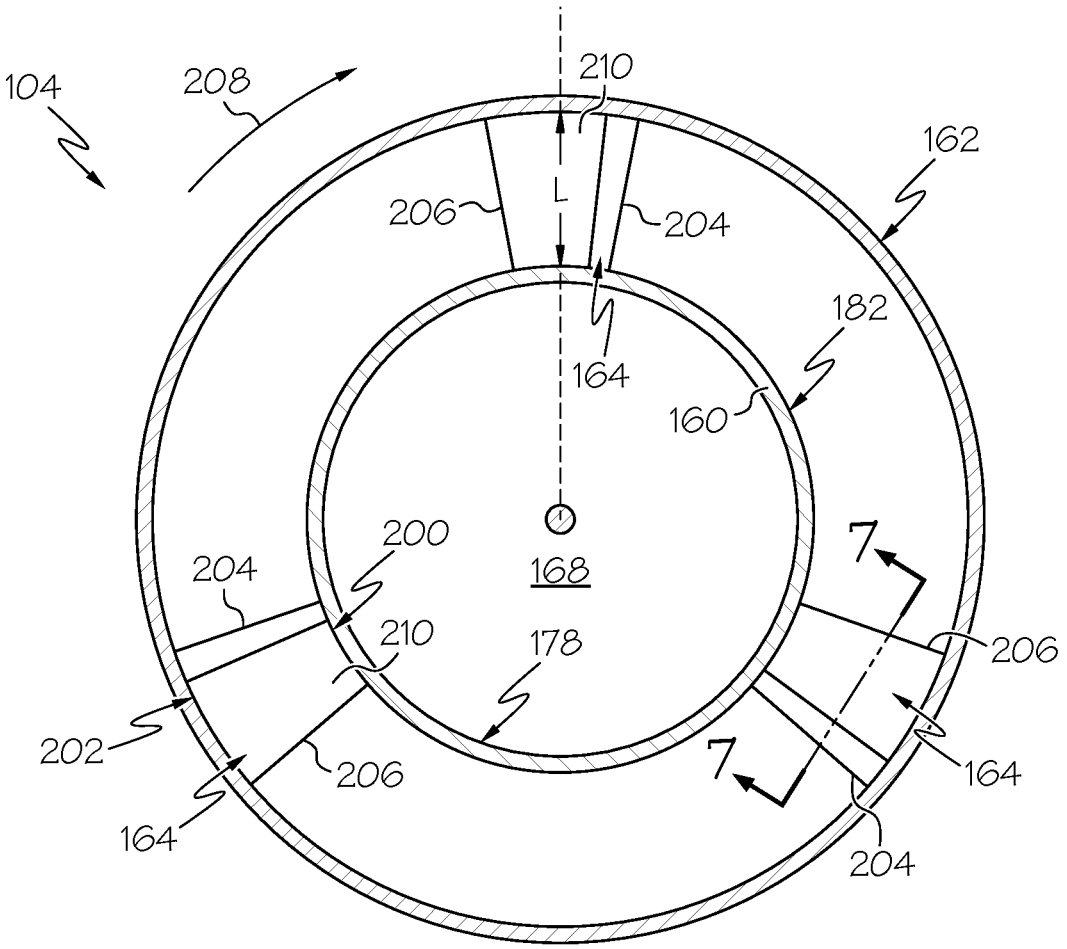
FIG. 6 is a top view, in partial cross-section, of the mixing apparatus of FIG. 2, in accordance with one or more embodiments of the present disclosure.
Figure 7:
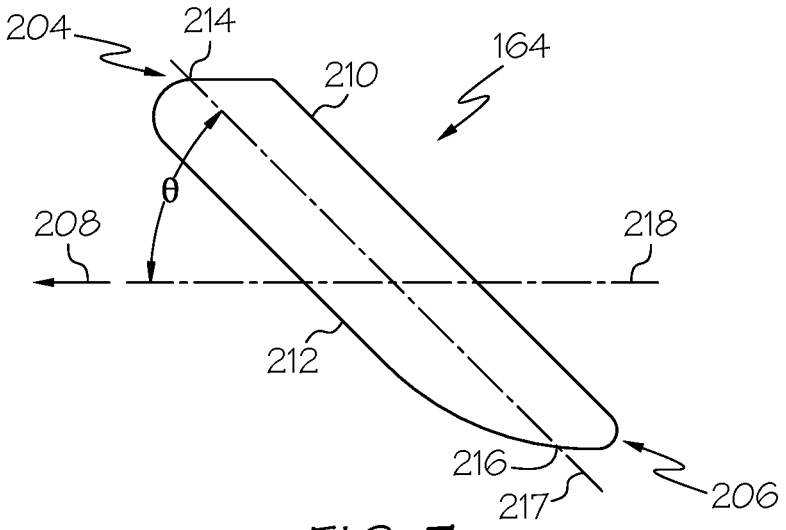
FIG. 7 is a section view of a vane of the mixing apparatus of FIG. 6 taken along section line 7-7 in FIG. 6, in accordance with one or more embodiments of the present disclosure.

Referring to FIGS. 5-7, each of the vanes 164 may have a leading edge 204 generally oriented towards the direction of rotation 208 of the mixing apparatus 104 about the axis of rotation A (FIG. 1) and a trailing edge 206 generally oriented in a direction opposite the direction of rotation 208. Each of the vanes 164 may have a constant radial length L from a cup end 200 to the loading cone end 202 of the vane 164. In one or more embodiments, each of the plurality of vanes 164 may have a constant width along the radial length L of the vanes 164. In one or more embodiments, each of the vanes 164 may have a width that varies along the radial length L of the vane 164. In one or more embodiments, each vane 164 may have the same size and shape as each of the other vanes 164 so that, when the vanes 164 are evenly radially distributed, the centrifuge 102 and mixing apparatus 104 are rotationally balanced during operation of the centrifuge system 100.

As shown in FIG. 7, each of the vanes 164 may have a contoured shape with a tapered leading edge 204, a tapered trailing edge 206, or both a tapered leading edge 204 and a tapered trailing edge 206, when viewed in cross-section. In one or more embodiments, each of the vanes 164 may have a tapered leading edge 204 and a tapered trailing edge 206. Each of the vanes 164, when viewed in cross-section, may have an aerodynamic shape, such as an airfoil shape, in which both the leading edge 204 and the trailing edge 206 are tapered. The leading edge 204 may have a leading edge contour 214, and the trailing edge 206 of the vane 164 may have a trailing edge contour 216. The vane 164 may have an upper vane surface 210 and a lower vane surface 212. In one or more embodiments, the vanes 164 may have a non-symmetrical airfoil-shaped cross-section, in which leading edge contour 214 is different than the trailing edge contour 216. In one or more embodiments, the leading edge contour 214 may be less tapered than the trailing edge contour 216. In one or more embodiments, the leading edge contour 214 may be tapered to provide low crystal impact. In one or more embodiments, the vane 164 may be a cambered airfoil in which a shape of the upper vane surface 210 has a different shape than the lower vane surface 212. In one or more embodiments, the upper vane surface 210 may be curved and the lower vane surface 212 may be curved and an upper curvature of the upper vane surface 210 may be different than a lower curvature of the lower vane surface 212.

Figure 8:
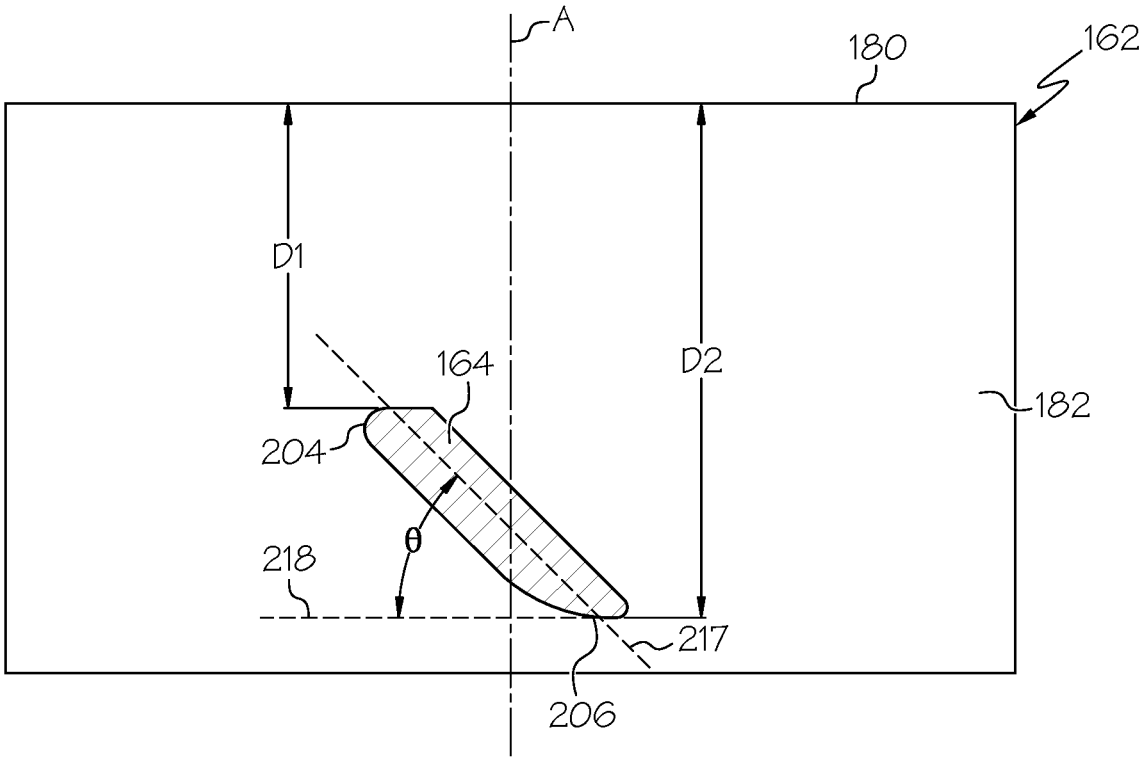
FIG. 8 is a side view, in partial cross-section, of the vane of FIG. 7 coupled to a cup of the mixing apparatus of FIG. 2, in accordance with one or more embodiments of the present disclosure.

As shown in FIGS. 5, 7, and 8 each of the vanes 164 may be angled in an axial direction relative to the axis of rotation A (FIG. 8) of the vertical spindle 110 (FIG. 1). With the vane 164 angled in the axial direction, the leading edge 204 of the vane 164 is axially offset from the trailing edge 206 of the vane 164 so that the leading edge 204 is not axially aligned with the trailing edge 206, and a midsagittal plane 217 of the vane 164, which extends radially from the cup end 200 to the loading cone end 202 and extends from the leading edge 204 to the trailing edge 206, is not parallel to an axial plane 218 (i.e., a plane perpendicular to the axis of rotation A of the vertical spindle 110). Referring to FIG. 8, with the vane 164 axially angled, the midsagittal plane 217 of the vane 164 may form a non-zero vane angle θ with the axial plane 218. The vane angle θ of the vane 164 may be selected so that a first distance D1 is defined from the leading edge 204 of the vane 164 to the top lip 180 of the cup 160 and a second distance D2 is defined from the trailing edge 206 of the vane 164 to the top lip 180 of the cup 160. In one or more embodiments, the first distance D1 may be less than the second distance D2, so that the leading edge 204 of the vane 164 is closer to the top lip 180 of the cup 160 than the trailing edge 206 of the vane 164.

In one or more embodiments, a plurality of airfoil-shaped vanes 164 may be strategically positioned and specially shaped to support the loading cone 162, while also providing low crystal impact and reduced feed stream interference, which may allow increased uniform loading of the filtering screen 136 (FIG. 1). During operation of the continuous centrifuge system 100, each of the vanes 164 continuously passes through a layer of the massecuite composition flowing downward along the inner surface 166 of the loading cone 162. The vanes 164 may displace the massecuite composition, forcing the massecuite composition to travel above or below the vane 164. The tapered leading edge 204 of the airfoil vanes 164 reduces the direct impact of sugar crystals in the massecuite composition 302 against the leading edge 204 of the vanes 164, which reduces the damage done to the crystals by the vanes 164 passing through the massecuite composition 302. When airfoil-shaped vanes 164 mounted with the leading edge 204 closer to the top lip 180 of the cup 160 than the trailing edge 206 are used, the lower vane surface 212, which slopes downward away from the leading edge 204, may exert a downward pumping force on the massecuite composition passing under the vane 164, which may cause the downward flow rate of the massecuite composition to increase locally as the vane 164 passes through the layer of massecuite composition. Additionally, the upper vane surface 210, which also slopes downward from the leading edge 204, may create a localized vacuum at the upper vane surface 210 proximal to the trailing edge 206 of the vane 164. This localized vacuum may create a vacuum force that may pull the massecuite composition downward toward the trailing edge 206 of the vane 164. The vacuum force may cause the massecuite composition displaced vertically above the vane 164 to flow down and recombine with the massecuite composition displaced vertically below the vane 164. By causing the massecuite composition displaced by passage of the vanes 164 to recombine proximal to the trailing edges 206 of the vanes 164, the vanes 164 may help to maintain a continuous film or layer of massecuite composition on the inner surface 166 of the loading cone 162 (FIG. 5) and, therefore, a constant flow of the massecuite composition to the basket 108 (FIG. 1) of the centrifuge 102 (FIG. 1), which may provide more even loading of the filtering screen 136.

Referring to FIG. 1, the feed pipe 106 may deliver the massecuite composition to the mixing apparatus 104 coupled to centrifuge 102. The feed pipe 106 may be a vertical feed pipe and may define an upper end 220 and a lower end 222, wherein the feed pipe outlet 224 is positioned at the lower end 222 of the feed pipe 106. The feed pipe 106 may define a feed pipe cavity 226 disposed between the upper end 220 and the lower end 222. The massecuite feed may enter the feed pipe cavity 226 through a feed inlet 228, which may be coupled to or proximal to the upper end 220 of the feed pipe 106. The feed inlet 228 is configured to deliver a feed composition, such as a massecuite feed, into the feed pipe cavity 226.

The feed pipe 106 may also have one or more low-viscosity fluid inlets 230, which may be positioned to introduce one or more low-viscosity fluids to the feed pipe cavity 226 to adjust the viscosity of a viscous feed composition, in particular a massecuite feed. As used herein, the term "low-viscosity fluids" refers to fluids having a viscosity that is at least less than the viscosity of the massecuite feed. Low-viscosity fluids may include water, partially diluted molasses, surfactant or surfactant solution, other low viscosity fluids, or combinations of these. In one or more embodiments, the low-viscosity fluid inlet 230 may include a water inlet pipe. At least one of the low-viscosity fluid inlets 230 may be fluidly coupled to a dispenser 231, which may include a union 232 coupled to a rod 234, the union 232 and the rod 234 being positioned within the feed pipe cavity 226. The rod 234 may be positioned proximal to a centerline B of the feed pipe 106 and may be operable to deliver the low-viscosity fluid, or other additives, to a central portion of the massecuite feed flow.

The union 232 may be operable to dispense the low-viscosity fluid, such as water for example, from the low-viscosity fluid inlet 230 to the outer surface of the rod 234. The massecuite feed passing through the feed pipe cavity 226 may slide down and around the rod 234, picking up the low-viscosity fluid from the surface of the rod 234. The flow of the massecuite feed through the feed pipe cavity 226 may provide only a small amount of mixing of the low-viscosity fluids into the massecuite feed to form the massecuite composition, which may be non-homogeneous upon exiting the feed pipe outlet 224. In one or more embodiments, the union 232 and rod 234 of the dispenser 231 may be positioned coaxially within the feed pipe 106. The dispenser 231 may be positioned upstream of the feed pipe outlet 224.

In one or more embodiments, the dispenser 231 may be used to add water to the massecuite feed. The water may have a temperature of from 50 degrees Celsius (° C.) to 80° C., from 50° C. to 70° C., from 50° C. to 65° C., from 60° C. to 80° C., from 65° C. to 70° C., or from 70° C. to 80° C.

The feed pipe 106 may further comprise a fluid flow control device (not shown) disposed at the feed inlet 228 that is configured for controlling entry of the feed composition into the feed pipe 106. The fluid flow control device may be a fluid flow regulating valve that may be a butterfly valve, knife valve, gate valve, etc. Other suitable valves or fluid flow control devices are also contemplated.

A temperature of the massecuite composition may be measured using a temperature sensor (not shown) and controlled by an automatic temperature controller (not shown). In one or more embodiments, the temperature controller may control one or more temperature control devices (not shown), which may include, but is not limited to, a massecuite feed valve positioned at the feed inlet 228, a low viscosity feed valve positioned in the low-viscosity fluid inlet 230, a steam inlet valve in fluid communication with a heating jacket coupled to the feed pipe 106, one or more stationary and/or rotating heating elements positioned within the feed pipe cavity 226, other temperature control device, or combinations of control devices. In one or more embodiments, the feed pipe 106 may include a heating jacket or other heating device.

Referring to FIG. 2, the feed pipe 106 may extend through the narrow end 192 of the loading cone 162 and into the cup 160. The feed pipe outlet 224 may be positioned within the cup 160, but spaced apart from the upper surface 168 of the cup 160, to deliver the massecuite composition, which may include the massecuite feed, the low-viscosity fluid, and any other additives, to the upper surface 168 of the cup 160. The feed pipe 106 may be positioned so that the centerline B of the feed pipe 106 is offset from the axis of rotation A of the vertical spindle 110. Offsetting the feed pipe 106 relative to the axis of rotation A of the vertical spindle 110 may cause the massecuite composition exiting the feed pipe outlet 224 to contact the upper surface 168 of the cup 160 in the same radial position throughout operation of the continuous centrifuge system 100. This may prevent random shifting of the radial position of contact of the massecuite composition feed on the upper surface 168 of the cup 160, which may lead to unbalanced operation of the centrifuge 102. Unbalanced operation of the centrifuge 102 may result in vibrations, which may increase noise levels produced by the centrifuge 102 and/or may increase wear on the centrifuge 102, among other undesired effects.

The feed pipe 106 may add one or more low-viscosity fluids or other additives to the massecuite feed to form a massecuite composition having a lower viscosity so that a faster and more effective crystal-liquid separation may result. Specifically, the addition of surfactants may reduce the surface tension of the massecuite and facilitate the separation of sugar crystals from the liquid molasses (i.e., purging). In one or more embodiments, the total weight percent (wt. %) of low-viscosity fluids in the massecuite composition may be from 0.1% to 8%, or from 0.1% to 6%. In one or more embodiments, no low-viscosity fluids may be added to the massecuite feed such that the massecuite composition is the same as the massecuite feed.

The addition of low-viscosity fluids (e.g., water, surfactants, partially diluted molasses, etc.) to a highly viscous massecuite can lead to difficulty or inability of the two fluids to readily mix. The mixing apparatus 104, which is disposed between the feed pipe outlet 224 and the basket 108 of the centrifuge 102, may operate to mix the massecuite composition, which may include the massecuite feed, the low-viscosity fluids, and other additives, to form a homogeneous massecuite composition. The ability to add low-viscosity fluids to the massecuite feed and produce a homogeneous massecuite composition entering the centrifuge 102 may reduce the amount of low viscosity fluids necessary to add to a saturated suspension of sucrose and water to lower the viscosity of the massecuite feed introduced to the feed pipe 106. Therefore, the continuous centrifuge system 100 having the mixing apparatus 104 and feed pipe 106 disclosed herein may aid in minimizing a shift in the crystallization equilibrium towards dissolution, thus, minimizing the amount of sucrose crystals that dissolve back into solution (i.e., the molasses).

Figure 9:
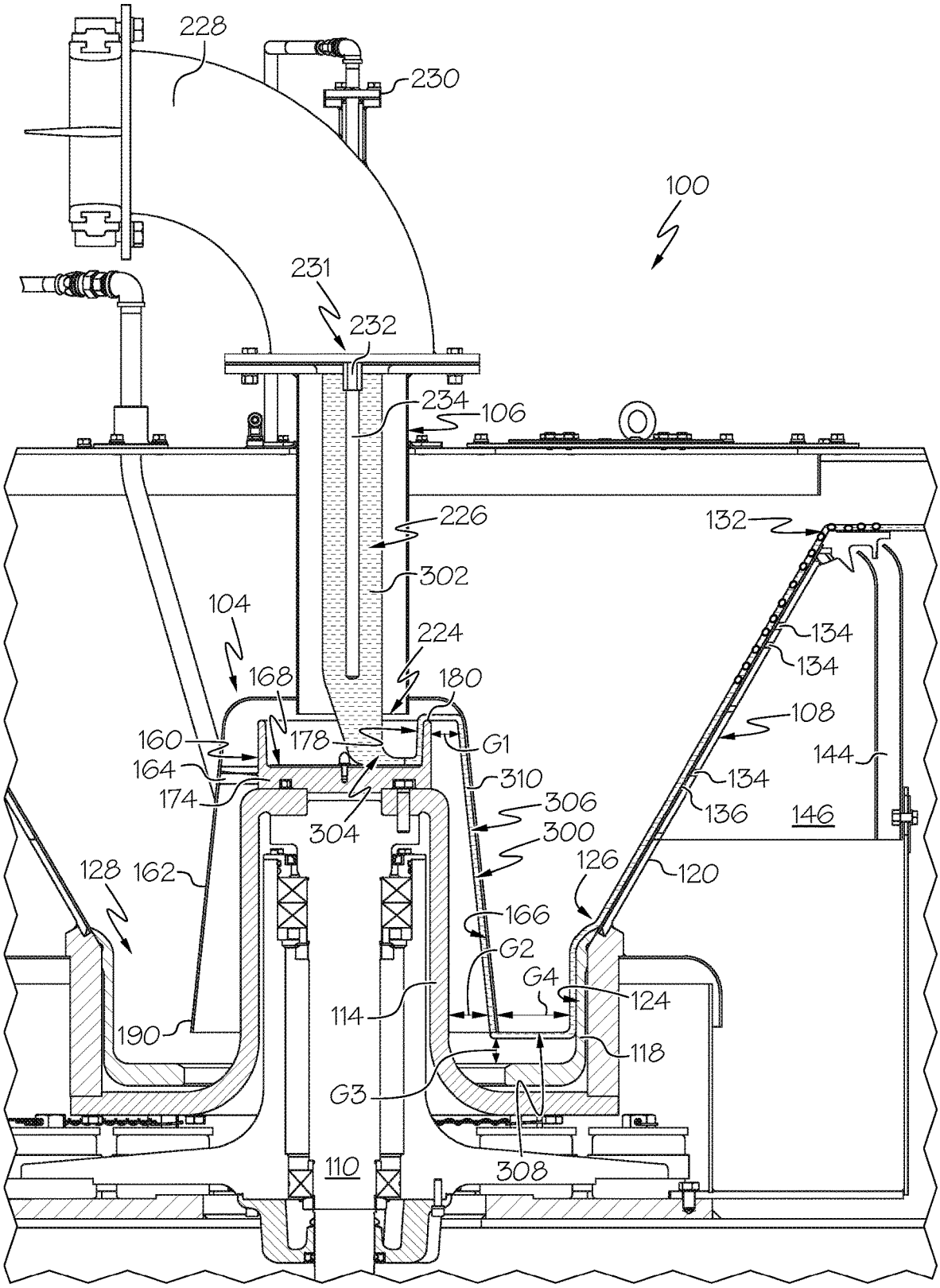
FIG. 9 schematically depicts a continuous centrifuge system, in accordance with one or more embodiments of the present disclosure.

Referring now to FIG. 9, the mixing apparatus 104 may provide a flow path 300 of the massecuite composition 302 from the feed pipe outlet 224 to the lower edge 126 of the separating wall 120 of the basket 108 to increase the residence time and mixing of the mixing apparatus 104, which may enable the mixing apparatus 104 to deliver a more homogeneous massecuite composition 302 to the separating wall 120 and the filtering screen 136 coupled thereto.

The continuous centrifuge system 100, including the mixing apparatus 104 and the basket 108 of the centrifuge 102, may define a plurality of mixing zones from the feed pipe outlet 224 to the lower edge 126 of the separating wall 120. In one or more embodiments, the continuous centrifuge system 100 may comprise a first mixing zone 304 extending from the feed pipe outlet 224 to a lip 180 of the cup 160, a second mixing zone 306 extending from the lip 180 of the cup 160 to the wide end 190 of the loading cone 162, and a third mixing zone 308 extending from the wide end 190 of the loading cone 162 to the lower edge 126 of the separating wall 120 of the basket 108 and the filtering screen 136 coupled thereto.

In the first mixing zone 304, the massecuite composition 302 (or other composition) may travel from the feed pipe outlet 224 axially downward to the upper surface 168 of the base 174 of the cup 160, flow radially outward along the upper surface 168 of the cup 160 through centrifugal force, impinge upon the inner radial surface 178 of the sidewall 176 of the cup 160, and then flow axially upward along the inner radial surface 178 of the sidewall 176 to the top lip 180 of the cup 160. The tortuous flow path 300 of the massecuite composition 302 through the first mixing zone 304 may cause the massecuite composition 302 to travel across an axial gap defined between the feed pipe outlet 224 and the upper surface 168 of the cup 160. The massecuite composition 302 may then contact the upper surface 168 of the cup 160, and through said contact, the massecuite composition 302 may be accelerated radially outward along the upper surface 168 of the cup 160 through centrifugal force. The massecuite composition 302 may impinge upon the inner radial surface 178 of the sidewall 176 of the cup 160 and then may travel axially along the inner radial surface 178 of the sidewall 176 of the cup 160 to the top lip 180 of the cup 160. Radial flow of the massecuite composition 302 across the upper surface 168 of the cup 160, impingement of the massecuite composition 302 against the inner radial surface 178 of the cup 160, and axial flow of the massecuite composition 302 along the inner radial surface 178 of the cup 160 to the top lip 180 of the cup 160 may each contribute to mixing of the massecuite composition 302.

In the second mixing zone 306, the massecuite composition 302, upon reaching the top lip 180 of the cup 160 and exiting the first mixing zone 304, may flow, through centrifugal force, from the top lip 180 of the cup 160 radially outward across the first radial gap G1 defined between the top lip 180 of the cup 160 and the inner surface 166 of the loading cone 162 to impinge upon the inner surface 166 of the loading cone 162. The massecuite composition 302 may then flow generally downward along the inner surface 166 of the loading cone 162 in a continuous layer or film to the wide end 190 of the loading cone 162. The flow path 300 of the massecuite composition 302 through the second mixing zone 306 may cause the massecuite composition 302 to be slung radially outward across the first radial gap G1, impinge upon the inner surface 166 of the loading cone 162, and travel generally downward towards the wide end 190 of the loading cone 162 through centrifugal force. Slinging the massecuite composition 302 across the first radial gap G1, impinging the massecuite composition 302 against the inner surface 166 of the loading cone 162, and conveying the massecuite composition 302, through centrifugal force, downward along the inner surface 166 of the loading cone 162 may each contribute to mixing of the massecuite composition 302.

In the third mixing zone 308, the massecuite composition 302, upon reaching the wide end 190 of the loading cone 162 and exiting from the second mixing zone 306, may travel radially outward, through centrifugal force, across the annular channel 128 of the basket 108 from the wide end 190 of the loading cone 162 to the solid radial wall 118 of the basket 108, impinge upon the inner radial surface 124 of solid radial wall 118, and flow upward along the inner radial surface 124 of the solid radial wall 118 of the basket 108 to the lower edge 126 of the separating wall 120 and the filtering screen 136. The flow path 300 of the massecuite composition 302 through the third mixing zone 308 may cause the massecuite composition 302 to be slung radially outward from the wide end 190 of the loading cone 162, across the fourth gap G4 defined radially between the wide end 190 of the loading cone 162 and the inner radial surface 124 of the solid radial wall 118 of the basket 108, to impinge upon the inner radial surface 124 of the solid radial wall 118, and to travel upward, through centrifugal force, along the inner radial surface 124 of the solid radial wall 118 of the basket 108 to the lower edge 126 of the separating wall 120. Slinging the massecuite composition 302 across the fourth gap G4, impinging the massecuite composition 302 against the inner radial surface 124 of the solid radial wall 118, and conveying the massecuite composition 302 upward along the inner radial surface 124 of the solid radial wall 118 may each contribute to mixing of the massecuite composition 302. The massecuite composition 302 may be a generally homogeneous massecuite composition upon exiting the third mixing zone 308 at the lower edge 126 of the separating wall 120.

Referring to FIG. 9, in operation, a massecuite feed, which may include at least sugar crystals and molasses, may be introduced to the centrifuge system 100 from a storage tank or supply tank (not shown) or may come directly from an upstream sugar processing step (not shown), such as a crystallization step, for example. The massecuite feed may be introduced to the feed pipe 106 through the feed inlet 228. Water or other low-viscosity fluid may be added to the massecuite feed flowing through the feed pipe 106 to form a massecuite composition 302. The massecuite composition 302 may then be introduced to the mixing apparatus 104, in particular the upper surface 168 of the cup 160, from the feed pipe outlet 224. The centrifuge 102 (including the vertical spindle 110 and the basket 108) and the mixing apparatus 104 may be rotated about the axis of rotation A (FIG. 1) of the vertical spindle 110. Upon contacting the upper surface 168 of the base 174, inside the cup 160, the massecuite composition 302 is conveyed, through centrifugal force, radially outward along the upper surface 168 of the base 174. The massecuite composition 302 may impinge upon the inner radial surface 178 of the cup 160. Centrifugal forces created by the rotation of cup 160 of the mixing apparatus 104 with the centrifuge 102 may cause the massecuite composition 302 to migrate upwards along the inner radial surface 178 of the cup 160 to the top lip 180 of the cup 160.

When the massecuite composition 302 reaches the top lip 180 of the cup 160 (i.e., the top of the sidewall 176 of the cup 160), centrifugal forces may cause the massecuite composition 302 to be conveyed radially outward across the first radial gap G1 defined between the top lip 180 of the cup 160 and the inner surface 166 of the loading cone 162. The massecuite composition 302 may impinge on the inner surface 166 of the loading cone 162. Centrifugal forces created by the rotation of the loading cone 162 with the centrifuge 102 and gravitational forces may cause the massecuite composition 302 to flow generally downward towards the wide end 190 of the loading cone 162. The massecuite composition 302 may form a layer 310 or film on the inner surface 166 of the loading cone 162 as it travels downward. As the loading cone 162 is rotated with the centrifuge 102, the vanes 164 coupling the loading cone 162 to the cup 160 rotate and may penetrate through the layer 310 or film of massecuite composition 302 flowing downward along the inner surface 166 of the loading cone 162. As each vane 164 passes through the massecuite layer 310, the leading edge contour 214 (FIG. 7), trailing edge contour 216 (FIG. 7), and vane angle θ of each vane 164 may cause the vane 164 to exert a pumping force on the massecuite composition 302 displaced along the lower vane surface 212 (FIG. 7) and create a vacuum along an upper vane surface 210 (FIG. 7). The vacuum, the pumping force, or both created by each of the vanes 164 may cause the massecuite composition 302 to flow back into the region or space vacated by the passing vane 164 to reform the continuous massecuite layer 310. The increasing diameter of the loading cone 162 moving downward toward the wide end 190 may result in increasing the centrifugal forces exerted by the loading cone 162 on the massecuite composition 302 as it flows downward toward the wide end 190 of the loading cone 162.

When the massecuite composition 302 reaches the wide end 190 of the loading cone 162, which is disposed within the annular channel 128 defined by the basket 108, the massecuite composition 302 may again be flung or slung radially outward through centrifugal force across the fourth radial gap G4 defined between the wide end 190 of the loading cone 162 and the solid radial wall 118 of the basket 108. The massecuite composition 302 may impinge on the inner radial surface 124 of the solid radial wall 118 and may flow generally upward along the inner radial surface 124 of the solid radial wall 118 to the lower edge 126 of the separating wall 120 of the basket 108 and the filtering screen 136 coupled thereto. The radial flow, impingement, and axial flow of the massecuite composition 302 that occur from the feed pipe outlet 224 to the lower edge 126 of the separating wall 120 of the basket 108 may cause mixing of the massecuite composition 302, which may include the massecuite feed and one or more low-viscosity fluids, to form a homogeneous massecuite composition 302, which is then introduced to the filtering screen 136 coupled to the separating wall 120 of the basket 108. The tortuous flow path 300 of the massecuite composition 302 through the first mixing zone 304, second mixing zone 306, and third mixing zone 308, may also operate to increase the residence time of the massecuite composition 302 in mixing apparatus 104, which may improve the mixing.

As previously described in reference to FIG. 3, centrifugal forces created by rotation of the basket 108 of the centrifuge 102 may cause the massecuite composition 302 to flow upward along the filtering screen 136 from the lower edge 126 towards the upper edge 132 of the separating wall 120. The liquid portion (i.e., the molasses 156, which may include the low-viscosity fluids and any other additives) may pass through filtering screen 136, optionally through the intermediate screen (not shown), through the perforations 134 in the separating wall 120, through the liquid discharge passageway 146, and out of the centrifuge 102 through the liquid outlet 142 (FIG. 1). The sugar crystals 154 (i.e., the solids) may continue to migrate upwards along the filtering screen 136. The sugar crystals 154 may pass over the upper edge 132 of the separating wall 120, through the solids discharge passageway 144, and out of the centrifuge 102 through the solids outlets 140 (FIG. 1). As previously described, water or steam may be added to the massecuite composition 302 as it migrates upward along the filtering screen 136.

Figure 10:
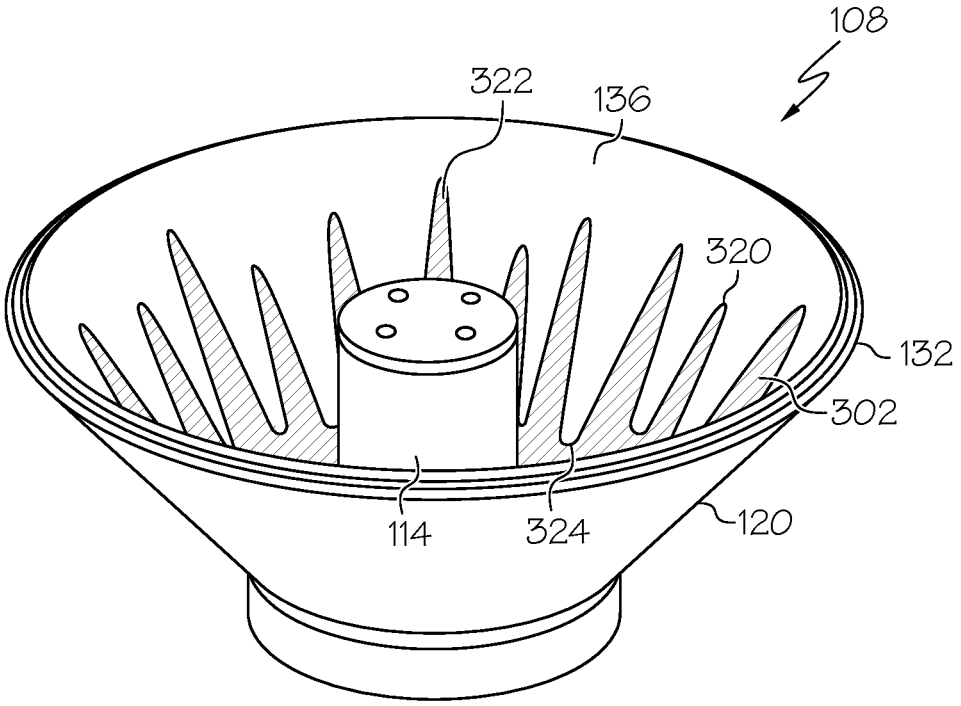
FIG. 10 (PRIOR ART)
FIG. 10 schematically depicts a basket of a conventional centrifuge in operation, the conventional centrifuge exhibiting long streaks on a filtering screen of the basket.

Referring now to FIG. 10, inefficient or incomplete mixing of the massecuite composition 302 may result in a non-homogeneous massecuite composition. A non-homogeneous massecuite composition may cause striations or long streaks 320 of molasses (also known as "fingers"), which may be observed inside the basket 108. The long streaks 320 of molasses may indicate a high viscosity molasses 322 that is not purging as quickly through the filtering screen 136 as lower viscosity molasses 324 (in adjacent areas between the long streaks 320. This may result from, for example, uneven mixing of the massecuite composition 302 with other lower-viscosity fluids or uneven heat distribution. The long streaks 320 may also result from interruptions in the flow of the massecuite composition 302 from the feed pipe outlet 224 (FIG. 1) to the lower edge 126 (FIG. 1) of the separating wall 120. Interruptions in the flow may be caused by horizontal or vertical pins or struts (not shown) placed in the flow path 300 of the massecuite composition 302. When long streaks 320 are present on the filtering screen 136 of the basket 108, the flow rate of the massecuite composition 302 to the filtering screen 136 must be decreased to prevent molasses from the long streaks 320 from passing over the upper edge 132 of the separating wall 120 and remaining with the solid sugar crystals that flow into the solid discharge passageway 144. Therefore, the presence and detection of the long streaks 320 on the filtering screen 136 may reduce the load that can be placed on the filtering screen 136, which reduces throughput through the continuous centrifuge system 100.

Figure 11:
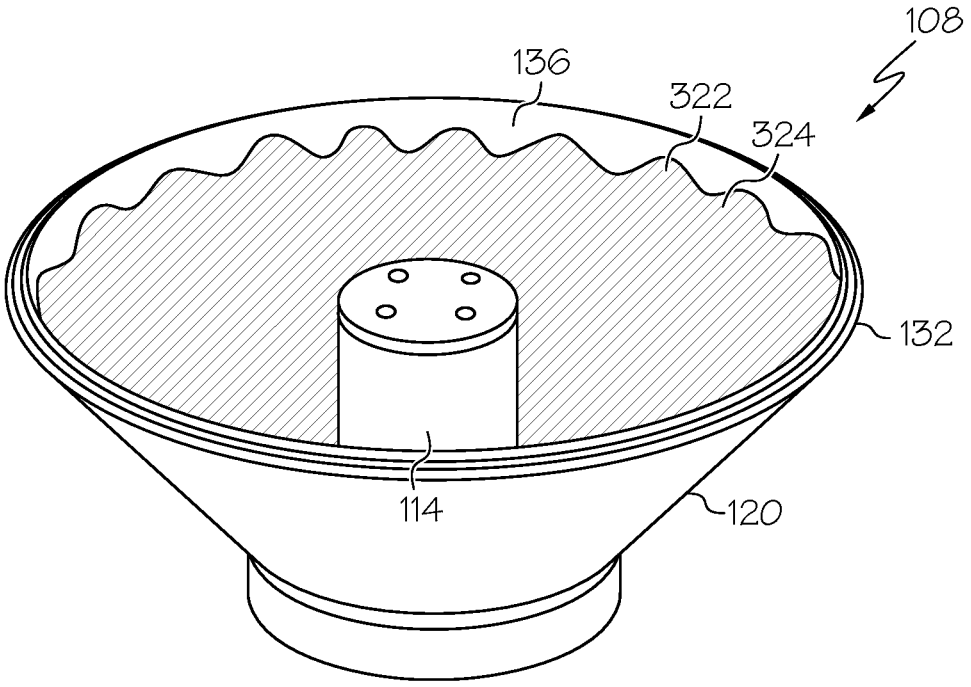
FIG. 11 schematically depicts a basket of the continuous centrifuge system of FIGS. 1 and/or 9 in operation, the basket exhibiting short streaks on the filtering screen of the basket, in accordance with one or more embodiments of the present disclosure.

Referring now to FIG. 11, the continuous centrifuge system 100 (FIG. 1) having the mixing apparatus 104 and radial vanes 164 may exhibit shorter streaks 326 during operation. The shorter streaks 326 may appear like a series of low bumps and shallow recesses, as shown in FIG. 11, rather than the long "fingers" illustrated in FIG. 10. The presence of shorter streaks 326 may indicate that the molasses is purging at a fairly constant rate through the filtering screen 136 and separating wall 120 of the basket 108. This may result when the mixing apparatus 104 disclosed herein is used to produce a homogeneous mixture at the lower edge 126 of the separating wall 120. The shorter streaks 326 shown in FIG. 11 may also result from maintaining a more continuous and uniform layer of the massecuite composition 302, which may have fewer gaps or discontinuities, flowing down the inner surface 166 of the loading cone 162. The use of a plurality of vanes 164, which are shaped and positioned as disclosed herein, to couple the loading cone 162 to the cup 160 of the mixing apparatus 104 may reduce the gaps and discontinuities in the flow of massecuite composition 302 to the filtering screen 136, thus, reducing the long streaks 320 observed on the filtering screen 136 and illustrated in FIG. 10 for conventional centrifuges.

The continuous centrifuge system 100 disclosed herein that exhibits the shorter streaks 326 during operation may allow the flow rate of the massecuite composition 302 to be increased to a greater flow rate as compared to the longer streaks 320 of FIG. 10 exhibited by conventional centrifuges. The greater flow rate of the massecuite composition 302 to the basket 108 may increase the loading of filtering screen 136 while generally preventing the molasses portion of the massecuite composition 302 from reaching the upper edge 132 of the basket 108 and flowing into the solids discharge passageway 144 (FIG. 1). Increasing the loading of massecuite composition 302 on the filtering screen 136 may result in greater efficiency and throughput as compared to conventional centrifuges that exhibit the long streaks 320 (FIG. 10).

Referring to FIG. 1, a method for providing a homogeneous massecuite to a centrifuge 102 is disclosed that includes providing a centrifuge system 100 comprising a centrifuge 102 having a vertical spindle 110, a housing 112, and a basket 108 disposed within the housing 112. The basket 108 may further comprise a hub 114 coupled to the vertical spindle 110 for rotation therewith, a cup 160 coupled to the hub 114 or an end of the vertical spindle 110 and defining a central cavity 172 oriented in a direction away from the hub 114, and a loading cone 162 positioned over the cup 160 and coupled to the cup 160 by a plurality of vanes 164 extending outward from the cup 160 to an inner surface 166 of the loading cone 162. The loading cone 162 may have a wide end 190 open towards a bottom wall 116 of the basket 108, and the plurality of vanes 164 may be radially spaced apart. The centrifuge system 100 may also include a feed pipe 106 vertically oriented above the cup 160 and having a feed pipe outlet 224 oriented towards the cup 160.

Referring to FIG. 9, the method may further include mixing the massecuite composition 302 in the first mixing zone 304 through radial flow of the massecuite composition 302 by centrifugal force outward along an upper surface 168 of a base 174 of the cup 160, impingement of the massecuite composition 302 against the inner radial surface 178 of the sidewall 176 of the cup 160, and axial flow of the massecuite composition 302 along the inner radial surface 178 of the sidewall 176 of the cup 160 to the top lip 180 of the cup 160. The method may include introducing the massecuite composition 302 to a second mixing zone 306 extending from the top lip 180 of the cup 160 to the wide end 190 of the loading cone 162. The method may include mixing the massecuite composition 302 in the second mixing zone 306 through slinging the massecuite composition 302 radially across the first gap G1 defined between the top lip 180 of the cup 160 and the inner surface 166 of the loading cone 162, impinging the massecuite composition 302 against the inner surface 166 of the loading cone 162, and conveying the massecuite composition 302 through centrifugal force downward along the inner surface 166 of the loading cone 162 to the wide end 190 of the loading cone 162. The method may further include introducing the massecuite composition 302 to a third mixing zone 308 extending from the wide end 190 of the loading cone 162 and mixing the massecuite composition 302 in the third mixing zone 308 through slinging the massecuite composition 302 radially across an annular channel 128 defined in the basket 108 between the hub 114 and the solid radial wall 118 of the basket 108, impinging the massecuite composition 302 against the inner radial surface 124 of the solid radial wall 118, and conveying the massecuite composition 302 through centrifugal force upward along the inner radial surface 124 of the solid radial wall 118 to the lower edge 126 of the separating wall 120 of the basket 108.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein. Thus, it is intended that the specification cover the modifications and variations of the various described embodiments provided such modification and variations come within the scope of the appended claims and their equivalents.

Versions of the devices described above may be actuated mechanically or electromechanically (e.g., using one or more electrical motors, solenoids, etc.). However, other actuation modes may be suitable as well including but not limited to pneumatic and/or hydraulic actuation, etc. Various suitable ways in which such alternative forms of actuation may be provided in a device as described above will be apparent to those of ordinary skill in the art in view of the teachings herein.

Versions of the devices described above may have various types of construction. By way of example only, any of the devices described herein, or components thereof, may be constructed from suitable metals, ceramics, plastics, or combinations thereof. Various suitable ways in which these and other modifications to the construction of devices described herein may be carried out will be apparent to those of ordinary skill in the art in view of the teachings herein.

Having shown and described various versions in the present disclosure, further adaptations of the devices and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A centrifuge system comprising, a centrifuge having a vertical spindle, a housing, and a basket disposed within the housing, the basket further comprising;

a central hub coupled to the vertical spindle for rotation therewith;

a cup coupled to the central hub or an end of the vertical spindle, the cup defining a cavity oriented in a direction away from the central hub; and a loading cone positioned over the cup and coupled to the cup by a plurality of vanes extending outward from the cup to an inner surface of the loading cone, the loading cone having a wide end open towards a bottom of the basket, wherein the plurality of vanes are radially spaced apart and each of the plurality of vanes is angled in an axial direction relative to an axis of rotation of the vertical spindle; and a feed pipe vertically disposed above the cup and having a feed outlet oriented towards the cup.

2. The centrifuge system of claim 1, wherein a leading edge of each of the plurality of vanes is axially offset from a trailing edge of the each of the plurality of vanes.

3. The centrifuge system of claim 1, wherein a leading edge of each of the plurality of vanes is tapered.

4. The centrifuge system of claim 1, wherein a trailing edge of each of the plurality of vanes is tapered.

5. The centrifuge system of claim 1, wherein each of the plurality of vanes is an airfoil vane.

6. The centrifuge system of claim 1, wherein a radial dimension or a cross-sectional area of the loading cone increases moving from a narrow end to the wide end.

7. The centrifuge system of claim 1, wherein the loading cone is a frustoconical loading cone or a bell-shaped loading cone.

8. The centrifuge system of claim 7, wherein the feed pipe extends through the narrow end of the loading cone and the feed outlet of the feed pipe is disposed within the cavity defined by the cup and spaced apart from a base of the cup.

9. The centrifuge system of claim 1, wherein a center line of the feed pipe is radially offset from an axis of rotation of the vertical spindle.

10. The centrifuge system of claim 1, wherein the basket defines an annular channel radially positioned between the hub and a screen of the basket.

11. The centrifuge system of claim 10, wherein the wide end of the loading cone extends into the annular channel defined by the basket.

12. The centrifuge system of claim 1, further comprising a sugar outlet in fluid communication with an upper edge of the basket and a molasses outlet in fluid communication with one or more perforations in the basket.

13. The centrifuge system of claim 1, further comprising a first mixing zone extending from the feed outlet of the feed pipe to a lip of the cup.

14. The centrifuge system of claim 13, wherein the cup further comprises a base having an upper surface and a cylindrical sidewall extending axially from the upper surface, the cylindrical side wall having an inner radial surface, wherein the cavity is defined by the upper surface of the base and the inner radial surface of the cylindrical sidewall.

15. The centrifuge system of claim 14, wherein in the first mixing zone, a composition travels from the feed outlet of the feed pipe to the upper surface of the base of the cup, flows radially outward along the upper surface of the base by centrifugal force, impinges upon the inner radial surface of the cylindrical sidewall of the cup, and flows upward along the inner radial surface of the cylindrical sidewall to a lip of the cup.

16. The centrifuge system of claim 14, further comprising a second mixing zone extending from a lip of the cup to the wide end of the loading cone.

17. The centrifuge system of claim 16, wherein in the second mixing zone, a composition introduced to the cup and exiting from the first mixing zone flows from the lip of the cup radially outward across a gap defined between the lip of the cup and the inner surface of the loading cone to impinge upon the inner surface of the loading cone, wherein the composition flows downward along the inner surface of the loading cone to the wide end of the loading cone.

18. The centrifuge system of claim 16, further comprising a third mixing zone extending from the wide end of the loading cone to a lower edge of a filtering screen coupled to the basket.

19. The centrifuge system of claim 18, wherein in the third mixing zone, a composition, which is introduced to the first mixing zone and passes through the first mixing zone and the second mixing zone, exits the second mixing zone, travels radially across an annular channel defined by the basket between the wide end of the loading cone to an inner radial surface of the basket, impinges upon the inner radial surface of the basket, and flows upward along the inner radial surface of the basket to the screen.

20. The centrifuge system of claim 1, further comprising a first mixing zone extending from the feed outlet of the feed pipe to a lip of the cup, a second mixing zone extending from the lip of the cup to the wide end of the loading cone, and a third mixing zone extending from the wide end of the loading cone to a screen of the basket.

21. A method for providing a homogeneous messecuite composition to a centrifuge, the method comprising:

providing the centrifuge system of claim 1;

rotating the vertical spindle to cause the basket, the cup, and the loading cone to rotate;

while rotating the vertical spindle, introducing the massecuite composition comprising at least sugar crystals, molasses, and water to an upper surface of the cup;

subjecting the massecuite composition to a first mixing step in which the massecuite composition is conveyed by centrifugal force radially outward along the upper surface of the cup, impinged upon a first inner radial surface of a cylindrical sidewall of the cup, and conveyed axially along the first inner radial surface of the sidewall of the cup to a lip of the cup, wherein radial flow, impingement, and axial flow of the massecuite composition causes mixing of the massecuite composition;

subjecting the massecuite composition to a second mixing step in which the massecuite composition is conveyed by centrifugal force across a first radial gap defined between the lip of the cup and the inner surface of the loading cone, impinged upon the inner surface of the loading cone, and conveyed through centrifugal force downward along the inner surface of the loading cone towards the wide end of the loading cone, wherein radial flow, impingement, and downward flow of the massecuite composition in the second mixing step causes mixing of the massecuite composition; and delivering the massecuite composition to a filtering screen coupled to the basket.

22. The method of claim 21, wherein the basket of the centrifuge system defines an annular channel radially positioned between the central hub and a second inner radial surface of the basket and wherein the wide end of the loading cone extends into the annular channel defined by the basket; and wherein the method further comprises subjecting the massecuite composition to a third mixing step in which the massecuite composition is conveyed through centrifugal force radially outward across a second radial gap defined between the wide end of the loading cone and the second inner radial surface of the basket, impinged upon the second inner radial surface of the basket, and conveyed through centrifugal force upward along the inner radial surface of the basket, wherein radial flow, impingement, and upward flow of the massecuite composition in the third mixing step causes mixing of the massecuite composition.

23. The method of claim 21, wherein in the second mixing step, each of the plurality of vanes passes through a film of the massecuite composition flowing along the inner surface of the loading cone, wherein passage of each of the plurality of vanes through the film causes additional mixing of the massecuite composition.

24. A method for providing a homogeneous massecuite to a centrifuge, the method comprising:

providing a centrifuge system comprising:

a centrifuge having a vertical spindle, a housing, and a basket disposed within the housing, the basket further comprising:

a central hub coupled to the vertical spindle for rotation therewith; a cup coupled to the central hub or an end of the vertical spindle, the cup defining a cavity oriented in a direction away from the central hub; and a loading cone positioned over the cup and coupled to the cup by a plurality of vanes extending outward from the cup to an inner surface of the loading cone, the loading cone having a wide end open towards a bottom of the basket, wherein the plurality of vanes are radially spaced apart and each of the plurality of vanes is angled in an axial direction relative to an axis of rotation of the vertical spindle; and a feed pipe vertically oriented above the cup and having a feed outlet oriented towards the cup;

introducing a massecuite composition from the feed outlet to a first mixing zone;

mixing the massecuite composition in the first mixing zone through conveying the massecuite composition by centrifugal force outward along an upper surface of a base of the cup, impinging the massecuite composition against a first inner radial surface of a cylindrical sidewall of the cup, and conveying the massecuite composition axially along the first inner radial surface of the cylindrical sidewall of the cup to a lip of the cup;

introducing the massecuite composition to a second mixing zone extending from the lip of the cup to the wide end of the loading cone;

mixing the massecuite composition in the second mixing zone through slinging the massecuite composition radially across a first gap defined between the lip of the cup and an inner surface of the loading cone, impinging the massecuite composition against the inner surface of the loading cone, and conveying the massecuite composition through centrifugal force downward along the inner surface of the loading cone to the wide end of the loading cone.

25. The method of claim 24, further comprising:

introducing the massecuite composition to a third mixing zone extending from the wide end of the loading cone; and mixing the massecuite composition in the third mixing zone through slinging the massecuite composition radially across an annular channel defined in a bottom of the basket between the central hub and a second inner radial surface of the basket, impinging the massecuite composition against the second inner radial surface of the basket, and conveying the massecuite composition through centrifugal force upward along the second inner radial surface of the basket to a lower edge of a filtering screen coupled to the basket.

* * * * *